US006732405B2

(12) United States Patent
Oh

(10) Patent No.: US 6,732,405 B2
(45) Date of Patent: May 11, 2004

(54) VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 297 days.

(21) Appl. No.: 10/071,111

(22) Filed: Feb. 8, 2002

(65) Prior Publication Data

US 2003/0019073 A1 Jan. 30, 2003

(30) Foreign Application Priority Data

Jul. 28, 2001 (KR) ..... 2001-45773

(51) Int. Cl.[7] ..... A47L 9/12; A47L 9/14; A47L 9/16

(52) U.S. Cl. ..... 15/347; 15/353; 55/DIG. 3; 55/337

(58) Field of Search ..... 15/347, 350, 351, 15/352, 353; 55/337, 429, 459.1, 482, 486, DIG. 3

(56) References Cited

U.S. PATENT DOCUMENTS

| | | | | |
|---|---|---|---|---|
| 2,824,335 A | * | 2/1958 | Moffat | 15/345 |
| 4,581,050 A | | 4/1986 | Krantz | |
| 5,230,722 A | * | 7/1993 | Yonkers | 55/337 |
| 5,287,591 A | | 2/1994 | Rench et al. | |
| 6,070,291 A | | 6/2000 | Bair et al. | |
| 6,146,434 A | * | 11/2000 | Scalfani et al. | 55/334 |
| 6,197,096 B1 | | 3/2001 | Cartellone | |
| 6,260,234 B1 | | 7/2001 | Wright et al. | |
| 6,406,505 B1 | * | 6/2002 | Oh et al. | 55/337 |
| 2002/0046438 A1 | * | 4/2002 | Oh | 15/353 |

FOREIGN PATENT DOCUMENTS

| | | |
|---|---|---|
| EP | 0489468 | 11/1991 |
| JP | 4156810 | 5/1992 |
| SU | 548261 | 2/1997 |
| WO | 9712660 | 4/1997 |

* cited by examiner

*Primary Examiner*—Terrence R. Till
(74) *Attorney, Agent, or Firm*—Ladas & Parry

(57) ABSTRACT

A vacuum cleaner having a suction brush movably disposed at a lower portion of a cleaner body, a by-pass motor disposed in the cleaner body and generating a suction force at the suction brush. A cyclone dust-collecting apparatus disposed in the cleaner body has an inflow passage, into which air passing by the by-pass motor flows, and an outflow passage through which the air, cleaned by the separation effect of the centrifugal force created within the dust-collecting apparatus is discharged. A dust bag is disposed in the cleaner body and connects to the outflow passage for filtering minute dust entrained in the once cleaned air which is discharged from the cyclone dust-collecting apparatus.

3 Claims, 3 Drawing Sheets

VACUUM CLEANER

BACKGROUND OF THE INVENTION

1. Field of the Invention

The present invention relates generally to a vacuum cleaner using a by-pass motor. More specifically, the invention relates to a vacuum cleaner utilizing a cyclone dust collecting apparatus to filter the larger particles and a dust filter to remove the remaining smaller particles still entrained in the air after it has already passed through the cyclone dust collecting apparatus.

2. Description of the Related Art

FIG. 1 shows a conventional vacuum cleaner using a by-pass motor. Referring to FIG. 1, the vacuum cleaner comprises a cleaner body 1 and a suction brush 2 movably connected to a lower portion of the cleaner body 1. In the lower portion of the cleaner body 1, a by-pass motor (not illustrated) is disposed. Being driven, the by-pass motor generates a suction force at the suction brush 2. Due to the suction force, dirt is drawn in from a cleaning surface through the suction brush 2 with air. The drawn-in air flows into an inflow path, which is disposed in the cleaner body 1, passing by the by-pass motor. Then, the air flows into a dust pocket 4 connected to an outlet 3 of the inflow path. That is, the air including the dirt is drawn in through the suction brush 2 and then is directed into the dust pocket 4 by the discharge pressure of the by-pass motor, simply passing by the by-pass motor. An inner side of the dust pocket 4 is enclosed by a dust filter so that the dirt entrained in the air is filtered out and cleaned air is exhausted through the dust pocket 4. In the conventional vacuum cleaner, the dust pocket 4 is made of a porous material or cloth that does not restrict the flow of air that is discharged by the discharge pressure of the by-pass motor, and through the dust pocket 4. Also, the dust pocket 4 is provided with a zipper 4*a* for opening and closing the dust pocket 4 so that, when the dust pocket 4 is full of dirt, the dirt is easily emptied. Accordingly, when the dust pocket 4 becomes full of the dirt during a cleaning operation, the dust pocket 4 is emptied by removing the dust pocket 4 from the cleaner body 1, and then the extracting the dust filter from the dust pocket 4 through the opened zipper 4*a*. Next, the old dust filter is replaced with a new one in the dust pocket 4, and the old dust filter full of dirt is discarded.

However, the vacuum cleaner as shown in FIG. 1 is mainly used in work places such as a hotel or a shop. Considering the amount of use a vacuum cleaner get in these work places, the dust pocket 4 is required to be very frequently emptied. Thus, since the old dust filter is frequently replaced by a new one, the costs involved can be considerable.

Also, taking the cost into consideration, the dust filter may be recycled. However, it is very inconvenient to shake the dirt out of the dust filter, and additionally there is a sanitary problem due to the large amount of dust generated while the dirt is shaken out of the dust filter.

SUMMARY OF THE INVENTION

The present invention was developed in order to solve the above problems. An object of the present invention is to provide a vacuum cleaner having an improved structure such that filtered dirt can be easily removed and the operational cost can be reduced.

According to the present invention in order to achieve the above object, a vacuum cleaner is provided with a suction brush movably disposed at a lower portion of a cleaner body and a by-pass motor disposed in the cleaner body, which generates a suction force at the suction brush. A cyclone dust-collecting apparatus is disposed in the cleaner body and has an inflow passage, into which air passing by the by-pass motor flows, and an outflow passage through which the air cleaned by a separation effect of centrifugal force is discharged. A dust bag is disposed in the cleaner body and connected to the outflow passage for filtering minute dust entrained in the once cleaned air which is discharged from the cyclone dust-collecting apparatus.

The cleaner body preferably has a first air path connecting the by-pass motor to the inflow passage of the cyclone dust-collecting apparatus, and a second air path connecting the outflow passage of the cyclone dust-collecting apparatus to the dust bag.

DETAILED DESCRIPTION OF THE PREFERRED EMBODIMENT

A vacuum cleaner according to a preferred embodiment of the present invention is described below in greater detail with reference to the accompanying drawings.

Figure 1:
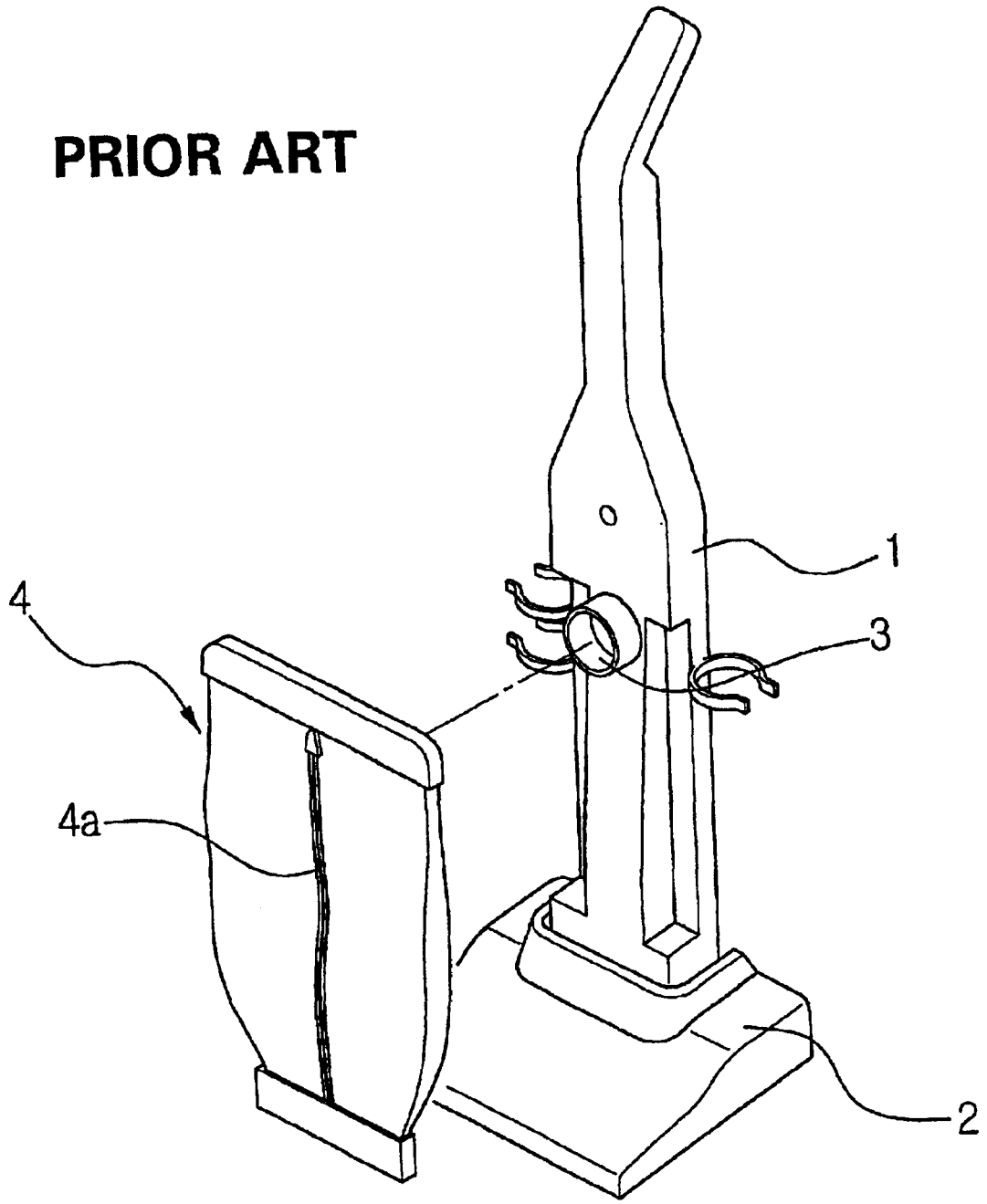
FIG. 1 is a partially exploded, perspective view showing a conventional vacuum cleaner.
Figure 2:
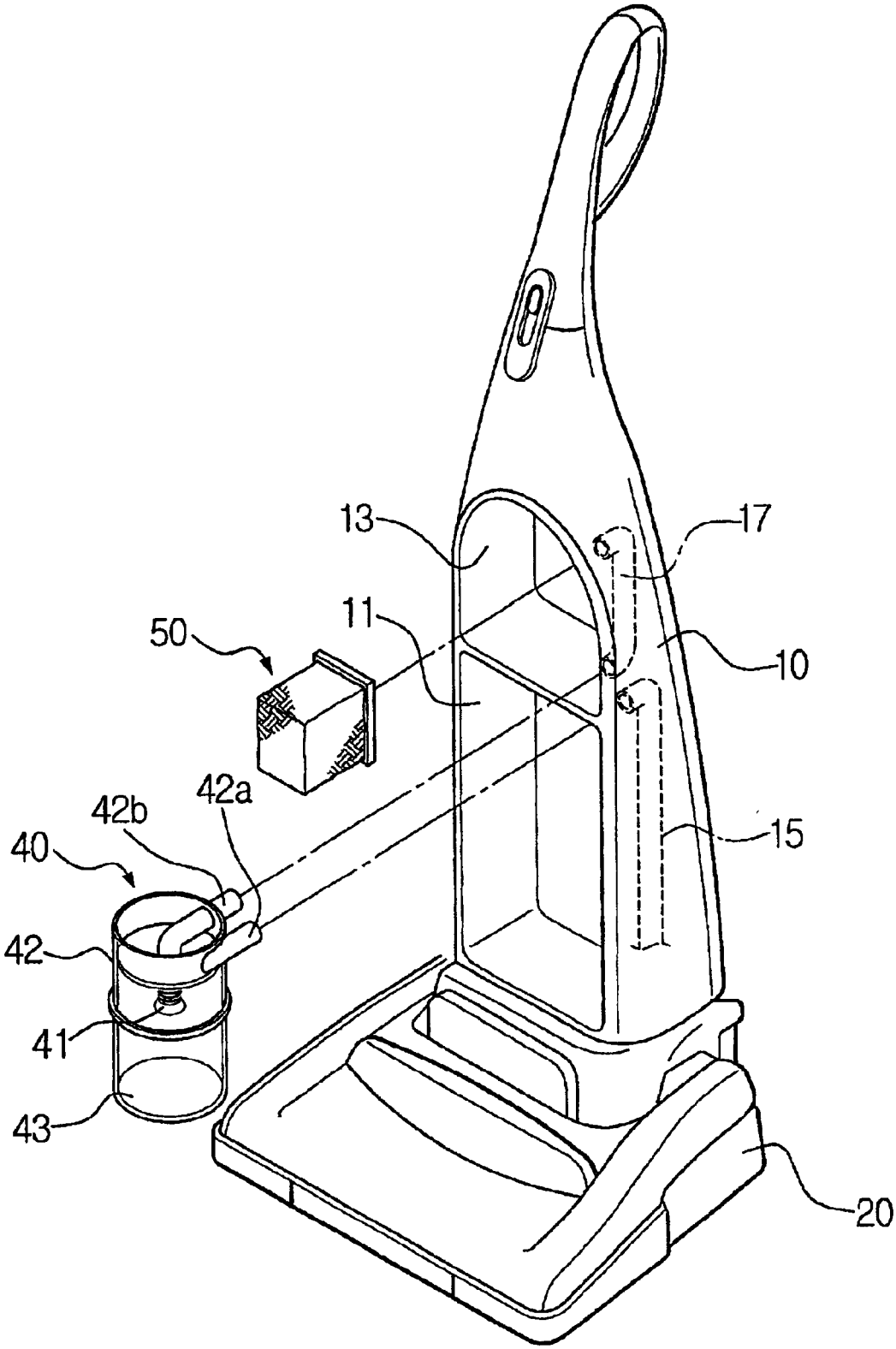
FIG. 2 is an exploded perspective view showing a vacuum cleaner in accordance with a preferred embodiment of the present invention.
Figure 3:
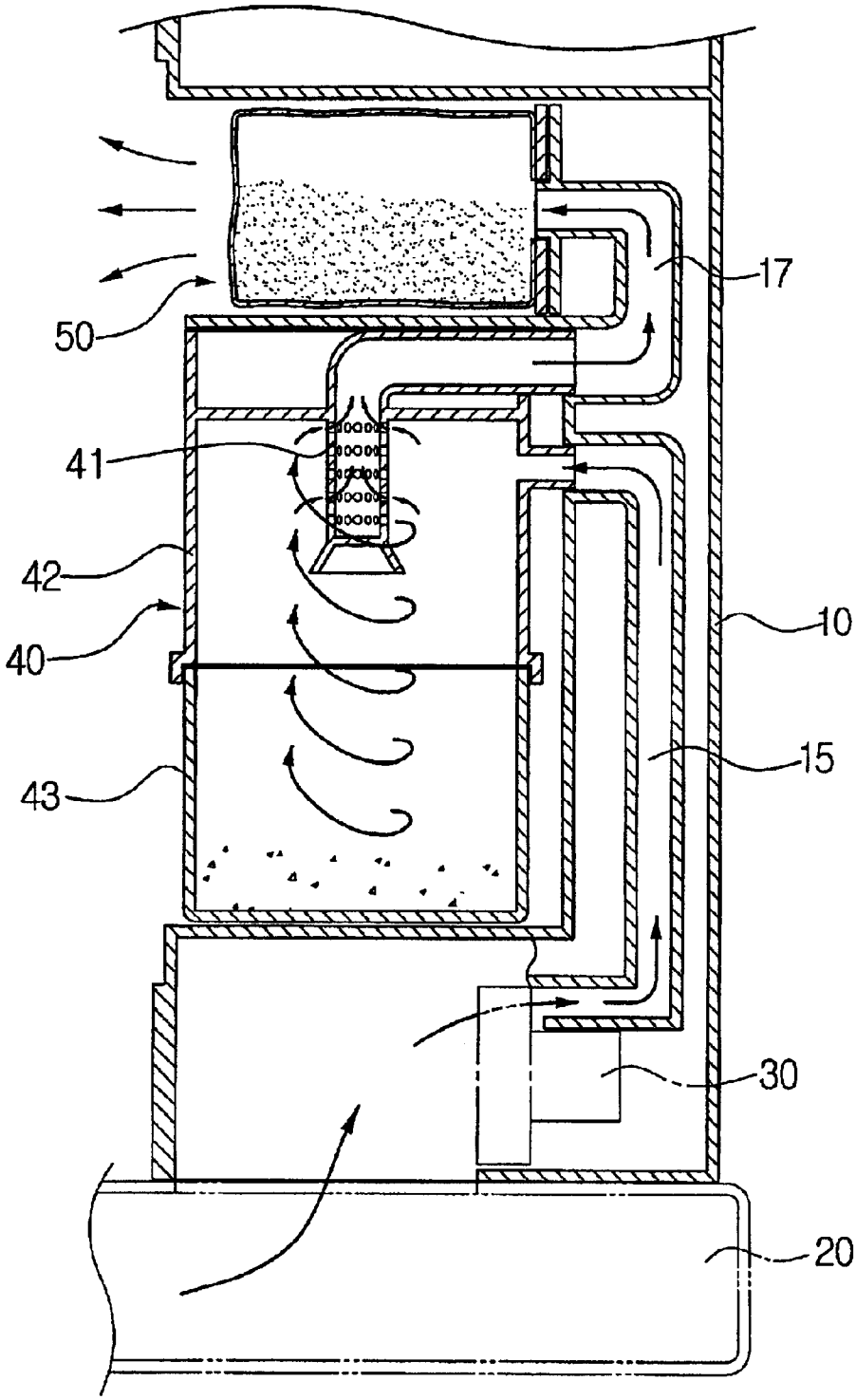
FIG. 3 is a cross-sectional view showing the vacuum cleaner of FIG. 2.

Referring to FIGS. 2 and 3, the vacuum cleaner comprises a cleaner body 10, a suction brush 20 removably disposed at a lower portion of the cleaner body 10, a by-pass motor 30 disposed in a lower portion of the cleaner body 10, a cyclone dust-collecting apparatus 40 and a dust bag 50 disposed in the cleaner body 10.

The cleaner body 10 of the up-right type vacuum cleaner has a handle disposed at an upper end thereof and mount portions 11 and 13 disposed at a front portion of the handle. The cyclone dust-collecting apparatus 40 and the dust bag 50 are disposed in the mount portions 11 and 13, respectively.

The suction brush 20 is capable of moving along a surface to be cleaned. When the by-pass motor 30 is driven, a suction force is generated at an inlet of the suction brush 20. Due to the suction force, dust or dirt is drawn in from the surface to be cleaned together with the air.

The by-pass motor 30 generates a suction force at the suction brush 20. The suction force generated by the by-pass motor sucks up dirt, dust or water, which are drawn in together with air. Accordingly, the air flowing into a front portion of the by-pass motor 30 flows out along a side portion of the by-pass motor 30, without passing through the by-pass motor itself. Since the by-pass motor 30 is a commonly used motor in upright vacuum cleaners, a detailed description thereof is omitted.

The cyclone dust-collecting apparatus 40 is removably disposed in the mount portion 11. The cyclone dust-collecting apparatus 40 preferably is a well-known dust-collecting apparatus, comprising a dust-collecting vessel 42 having a grill 41 and a dirt-collecting vessel 43 connected to a lower portion of the dust-collecting vessel 42. The dust-collecting vessel 42 is provided with an inflow passage 42*a* and an outflow passage 42*b*. The air passing by the by-pass motor 30 flows into the dust-collecting vessel 42 through the inflow passage 42*a*, and the air is cleaned by the separation effect of centrifugal force created in the dust-collecting vessel 42 by the swirling air passing from the outflow passage 42*a* to the outflow passage 42*b*. The air is then discharged from the dust-collecting vessel 42 through the outflow passage 42*b*. That is, the air flows into the dust-collecting vessel through the inflow passage 42*a* in an oblique direction, forming a vortex, and exits through the outflow passage 42*b*. Furthermore, due to the dirt separation effect of the vortex by centrifugal force, the larger particles of dirt fall on the dirt-collecting vessel 43, while the cleaned air flows up to be discharged through the outflow passage 42*b*.

Meanwhile, the cleaner body 10 comprises a first air path 15, which connects the by-pass motor 30 to the inflow passage 42*a* of the cyclone dust-collecting apparatus 40, and a second air path 17, which connects the outflow passage 42*b* of the cyclone dust-collecting apparatus 40 to the dust bag 50.

The dust bag 50 is removably disposed in the mount portion 13. The dust bag 50 is removably connected to the second air path 17 in order to filter minute dust particles entrained in the once cleaned air discharged from the cyclone dust-collecting apparatus 40. The dust bag 50 is made of material that allows the dust to be filtered by the dust bag 50, and the air is discharged therethrough by the discharge pressure of the air. The use of a dust bag 50 is well known in upright vacuum cleaners. Alternatively, a disposable dust bag may be employed as the dust bag 50 to be replaced with a new one when the dust bag 50 is full of the dirt.

The operation of the vacuum cleaner as constructed above according to the preferred embodiment of the present invention is described below.

First, the by-pass motor 30 is driven, generating a suction force at the inlet of the suction brush 20. Due to the suction force, air, including entrained dirt and dust, is drawn in through the suction brush 20. The air passes by the by-pass motor 30. Then, the air passing by the by-pass motor 30 flows into the cyclone dust-collecting apparatus 40 through the first air path 15 due to the discharge pressure. As described above, larger particles of dirt entrained in the air is filtered out by the cyclone dust-collecting apparatus 40, and this cleaned air is discharged toward the dust bag 50 through the outflow passage 17. Then, the cleaned air passes into the dust bag 50. The minute dust, which was not filtered out by the cyclone dust-collecting apparatus 40, is filtered out by the dust bag 50, while the air which has been even further cleaned is discharged through the dust bag 50.

Since the dirt of larger particles remains in the cyclone dust-collecting apparatus 40, and the dust of smaller particles is collected by the dust bag 50, the dust bag 50 doesn't become full of dust for a relatively long time.

Accordingly, while it is required for the dust-collecting apparatus 40 to be frequently emptied, it is not necessary to replace the dust bag 50 with a new one as frequently. Therefore, the costs of replacing the dust bag 50 are reduced. Since it is not necessary to empty the dust bag 50, the sanitary problem is solved. Since the dirt-collecting vessel 43 is removed from the dust-collecting vessel 42 to be emptied, the dirt-collecting vessel 43 can be semi-permanently used without requiring extra cost for replacement. Furthermore, the use of the dirt-collecting vessel is more sanitary because it does not require the user to shake the dust-collecting vessel 43 to empty the dirt from it, thereby preventing extra dust from being shaken into the air.

As described above, according to the present invention, the dirt entrained in the air drawn in by the discharge pressure of the by-pass motor 30 is first filtered out by the separation effect of centrifugal force in the dust-collecting vessel 42, and then the minute dust is secondarily filtered out by the dust bag 50.

Accordingly, since the period of usage for the dust bag 50 until replacement can be extended, the ultimate cost of using the dust bag 50 can be reduced. Also, since the cyclone dust-collecting apparatus 40 holds the larger particles of dirt therein, it is easily emptied by simply removing the dust-collecting vessel 43, which is more convenient and sanitary.

What is claimed is:

1. A vacuum cleaner comprising:

a suction brush movably disposed at a lower portion of a cleaner body;

a by-pass motor disposed in the cleaner body and generating a suction force at the suction brush;

a cyclone dust-collecting apparatus disposed in the cleaner body and having an inflow passage, into which air passing by the by-pass motor flows, and an outflow passage through which the air, cleaned by the separation effect of a centrifugal force created within the cyclone dust collecting apparatus, is discharged; and a dust bag disposed in the cleaner body and connected to the outflow passage for filtering minute dust entrained in the cleaned air, which is discharged from the cyclone dust-collecting apparatus.

2. The vacuum cleaner of claim 1, wherein the cleaner body comprises:

a first air path connecting the by-pass motor to the inflow passage of the cyclone dust-collecting apparatus; and a second air path connecting the outflow passage of the cyclone dust-collecting apparatus to the dust bag.

3. The vacuum cleaner of claim 1, wherein the dust bag is easily replaceable.

* * * * *